United States Patent [19]

Balsamo

[11] Patent Number: 4,787,160

[45] Date of Patent: Nov. 29, 1988

[54] GREETING CARD CONFETTI DELIVERY SYSTEM

[76] Inventor: Lawrence J. Balsamo, 539 Yosemite Court, Roselle, Ill. 60172

[21] Appl. No.: 50,606

[22] Filed: May 15, 1987

[51] Int. Cl.[4] ..... G09F 1/00

[52] U.S. Cl. ..... 40/124.1; 446/475; 206/634; 206/469; 206/470; 281/1

[58] Field of Search ..... 40/124.1; 446/147, 475, 446/483; 272/8 N; 281/1 R; 206/469, 467, 634

[56] References Cited

U.S. PATENT DOCUMENTS

| | | | |
|---|---|---|---|
| 3,798,806 | 3/1974 | Sanford | 40/124.1 |
| 4,363,081 | 12/1982 | Wilbur | 446/147 |
| 4,484,768 | 11/1984 | Norfleet | 446/147 |

*Primary Examiner*—Gene Mancene
*Assistant Examiner*—Michael Lynch
*Attorney, Agent, or Firm*—Willian Brinks Olds Hofer Gilson & Lione Ltd.

[57] ABSTRACT

A greeting card having a confetti delivery system which is triggerable is disclosed. In a preferred embodiment, the card includes a rupturing adhesive on the inside of a leaf opposite a confetti packet attached to a different leaf. A removable protective coating or covering prevents the confetti packet from contacting the rupturing adhesive when the untriggered card is opened. Removal of the covering triggers the card so that when it is opened thereafter the confetti packet ruptures.

9 Claims, 2 Drawing Sheets

GREETING CARD CONFETTI DELIVERY SYSTEM

BACKGROUND OF THE INVENTION

This application relates to greeting cards, and particularly relates to greeting cards which spew confetti when opened.

In the past, it has been known to provide greeting cards with confetti which falls out when the card is opened. A typical card of this design is usually provided in a kit containing a greeting card and a separate confetti supply. After the purchaser personalizes the card, such as by signing his name on an inside leaf, the confetti supply is emptied into the fold of the card, and the card is carefully placed inside an envelope, which is then sealed.

Such cards, while providing a card which will spill confetti when opened by the recipient, have the disadvantage that confetti often spills out when the card is removed from its envelope, or while the front of the card is being read, and the intended surprise effect is thereby lost.

It has also been known to attempt to overcome the above disadvantage by placing confetti in a tissue pouch which is then glued on each side between the leaves of a greeting card. This has the benefit of encapsulating the confetti until the card is opened, which tears the pouch. This approach, however, prevents the card from being personalized in the usual manner, since any opening of the card by the giver will destroy this pouch. Also, in the known embodiment of this design, the added thickness of the pouch resulted in a distorted shape to the card, arousing suspicion that the card contained something inside its fold, typically resulting in slow, cautious opening of the card and slow and only partial rupturing of the tissue pouch.

SUMMARY OF THE INVENTION

The present invention provides a greeting card comprising a rupturable packet of confetti which remains intact upon opening the untriggered greeting card and means for triggering the card so that thereafter the confetti packet ruptures on the next opening of the card. The advantage of the invention is that not only does the confetti not leak out when the card is read by the recipient, but also that the inscription on the inside of the card can be reviewed by the purchasing public without rupturing the packet. Further, as with typical greeting cards, the giver may personalize the card by signing it on an inside leaf before triggering the confetti delivery system.

The invention and its advantages will best be understood in view of the attached drawings, a brief description of which follow.

DETAILED DESCRIPTION OF THE DRAWINGS AND PREFERRED EMBODIMENTS OF THE INVENTION

As used herein, the term "greeting card" is to be broadly construed to include not only traditional birthday, get well, and special occasion cards, but also to include more elaborate structures having several adjacent leaves, pop up characters and the like. The invention is also applicable to promotional material, such as advertising brochures. Thus, the term "greeting card" also includes multiple-leaf brochures, magazines, books, etc.

Figure 1:
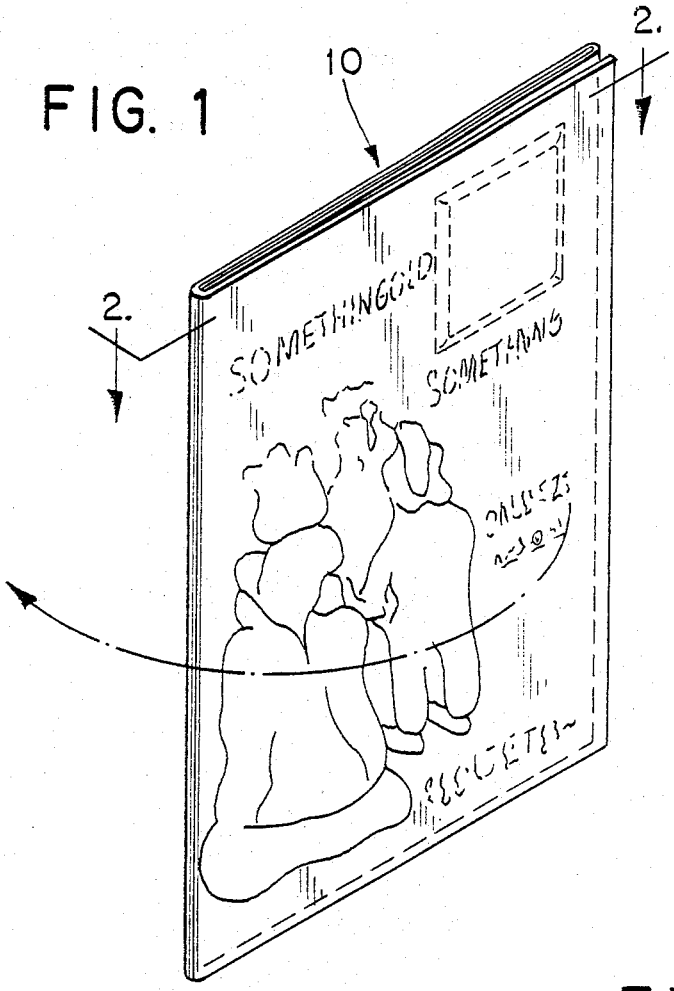
FIG. 1 is a perspective view of a greeting card of the preferred embodiment of the present invention.

The greeting card 10 of the preferred embodiment of the invention is shown in FIG. 1. As with other greeting cards, an inscription and picture may be included on the front face of the card 10, as well as on inside surfaces.

Figure 4:
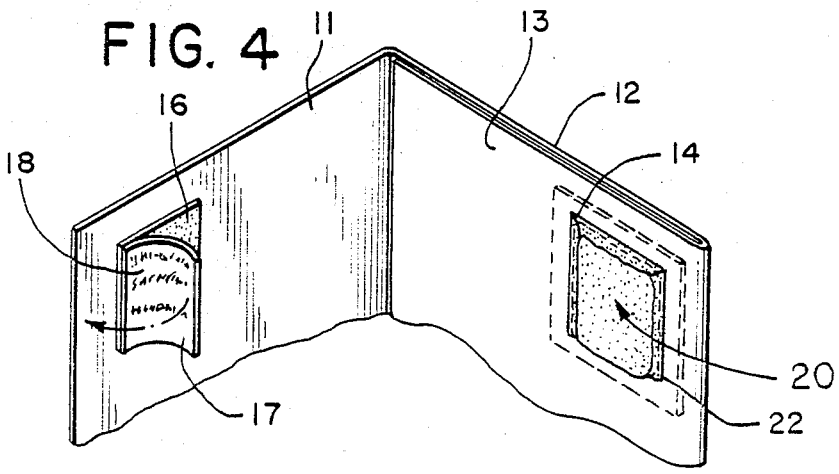
FIG. 4 is a perspective view of the card of FIG. 1 in an open position and being triggered.
Figure 6:
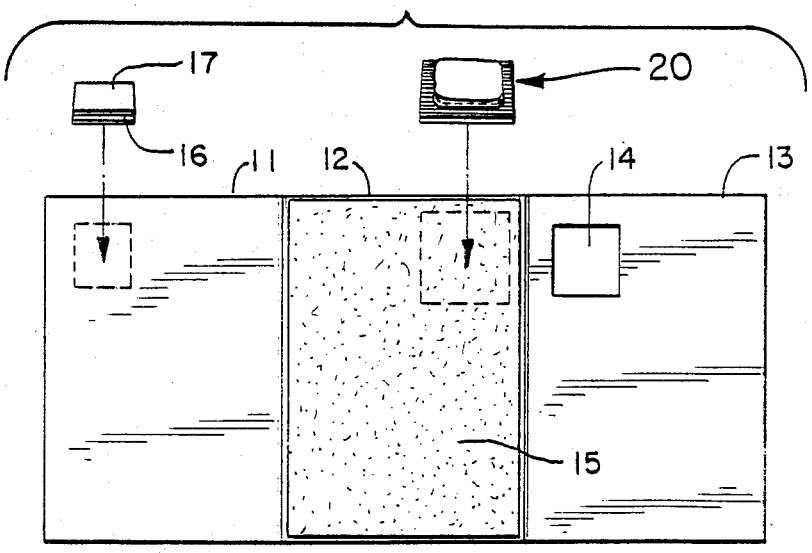
FIG. 6 is an exploded view of the greeting card of FIG. 1.

The card 10 is constructed of card stock. As shown in FIG. 6, the card is divided into three sections, designated by numerals 11, 12 and 13. The third section 13 includes an opening 14 near its upper left-hand corner. When constructing the card 10, an adhesive 15 is applied to the inside surface of second section 12. A confetti packet 20 is placed on the adhesive 15 near the upper right corner of second section 12. The third section 13 is folded over the second section 12 so that the opening 14 exposes the front face of the confetti packet 20. The folded design is shown in FIG. 4. The combined second and third sections 12 and 13 form a back leaf to the card 10, while the first section 11 forms the front leaf of card 10.

Figure 2:
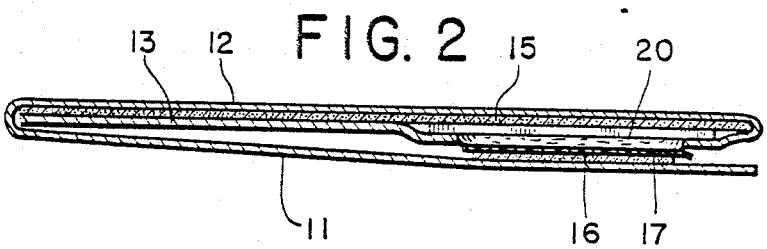
FIG. 2 is a sectional view taken along line 2—2 of FIG. 1.

A rupturing adhesive 16 with a protective layer or coating 17 is provided on the inside of front section 11 so as to be opposite the opening 14 when the card 10 is folded, as best shown in FIG. 2. In the preferred embodiment, the protective layer 17 is imprinted with instructions 18 for triggering the card. (FIG. 4) For example, the protective layer 17 may be one which has a release coat on its back surface, and the instructions 18 may instruct the individual triggering the card to peel away the layer 17 after the card is personalized.

Figure 5:
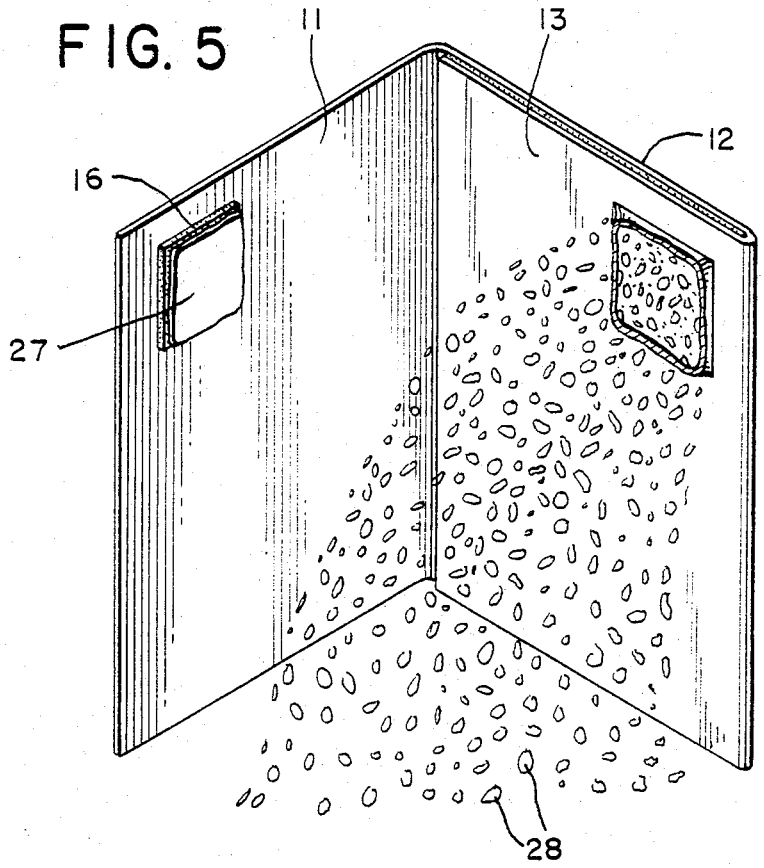
FIG. 5 is a perspective view of the card of FIG. 1 being opened after it has been triggered.

The rupturing adhesive 16 and construction of the packet 20 must provide an assembly which will rupture when the leaves of the card 10 are opened, as shown in FIG. 5, spewing confetti 28 from the packet. In the preferred embodiment, the packet 20 is made of kraft paper and includes a perforation 22 (FIG. 6) encompassing an area approximately equal to the size of opening 14. The perforation 22 allows the packet 20 to rupture, rather than the adhesive 16 releasing from either the inside surface of first section 11 or the confetti packet 20. The rupturing adhesive 16 must be correctly positioned, and should be slightly smaller in area than the opening 14, so that the rupturing adhesive 16 adheres only to the front surface of packet 20 and not to third section 13.

Figure 3:
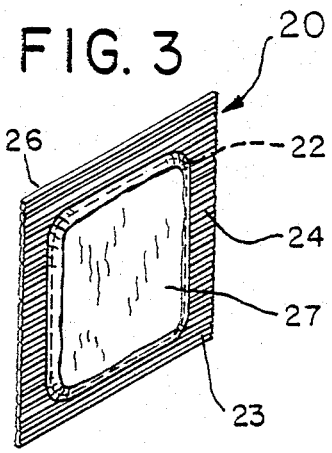
FIG. 3 is a perspective view of a confetti packet used in the card of FIG. 1.

The packet 20 is shown in detail in FIG. 3. In a simple construction the packet 20 is made from two pieces of kraft paper, a front side 24 and a back side 26. The two pieces are laminated around their periphery 23, leaving a center section into which confetti 28 is placed. The perforation 22 is formed in front side 24 and encompasses rupture section 27 of the front side 24. The packet 20 is constructed by placing confetti in a small mound on a web of paper, placing a second web of paper over the first web and cold sealing the webs together at the packet periphery 23. Thereafter the packet 20 may be cut to proper size and its front side 24 perforated.

The confetti 28 used in the packet 20 may include a variety of finely divided material, such as paper, plastic film, metal foils, and even seeds and spices. The confetti may differ depending on the inscription on the card. For example, in a card suggesting that the giver is presenting the recipient with a large amount of money, the packet may contain shredded currency as a confetti.

In the preferred embodiment of the invention, the card stock from which the card is made is 10 point cast coated card stock having a sheet size of about 15"×7". This material is preferred for its proper level of rigidity/flexibility and its receptivity to the adhesives and any inks used on the card. The opening 14 is square, about 1½" on each side. The packet is made from 30# bleached kraft paper with an outside dimension of about 2½" on each side of the square. The internal area inside the perforation 22 is about 1¼" on each side.

The adhesive 15 used to laminate the second and third sections 12 and 13 of the card 10 may be Terlan No. 2107 hot melt glue manufactured by Terlan Manufacturing Co. A preferred rupturing adhesive 16 is a two face adhesive tape measuring 1⅛"×1".

As previously mentioned, the present invention provides a card which will spew forth confetti upon opening but can be initially opened and personalized before the card is actually triggered. In the preferred embodiment, the fact that the packet 20 is perforated allows the confetti to rapidly leave the packet, caused by the complete opening of the rupture section 27, shown in FIG. 5 with the rupture section 27 stuck to the rupturing adhesive 16. When the packet 20 is thus fully and quickly opened, the inertia of the confetti and the flexibility of the card stock, and the air currents caused by the opening of the card 10, provides a dramatic release of the confetti 28 contained within packet 20.

In the preferred embodiment, the confetti packet is fairly thin. This fact, along with the opening 14 removing one thickness of card stock, provides a fairly flat card 10, which makes the card normal in appearance, resulting in a normal, rapid opening of the card 10.

Of course, it should be understood that a wide range of changes and modifications can be made to the preferred embodiment described above. For example, the confetti packet may be shaped and sized differently, and positioned at a different place in the card. Also, the confetti packet can be made of different materials, such as tissue paper, and may include more elaborate internal elements to expel the confetti when the packet is opened.

It is therefore intended that the foregoing detailed description be regarded as illustrative rather than limiting and that it be understood that it is the following claims, including all equivalents, which are intended to define the scope of this invention.

I claim:

1. A greeting card comprising:

(a) a flat sheet of material folded into first, second and third adjacent sections, the first section forming a first leaf of the card and the second and third sections being laminated together to form a second leaf of the card where the third section is interposed between the first and second sections when said card is folded closed, the third section including an opening therethrough:

(b) a packet of confetti interposed between the lamination of said second and third sections, said packet including a front face containing perforations defining a rupture section, said packet being positioned such that (i) the rupture section of said front face is exposed to the inside of said first leaf through said opening in said third section and (ii) said opening provides a space for the confetti to occupy to promote flat folding of the card;

(c) a rupturing adhesive positioned on said first section opposite said rupture section; and (d) a protective covering interposed between said adhesive and said front packet surface, said covering being removable to expose said adhesive to said front packet surface;

(e) whereby when said protective covering is removed and the card is closed the rupture adhesive contacts the rupture section and adheres with sufficient force to cause said rupture section to rupture and release the confetti in the packet upon the opening of the leaves.

2. The greeting card of claim 1 wherein the confetti comprises a finely divided material selected from the group consisting of paper, metal foil, plastic film, seeds and spices.

3. The greeting card of claim 2 wherein the confetti comprises shredded paper currency.

4. The greeting card of claim 1 wherein the flat material comprises card stock.

5. The greeting card of claim 4 wherein the card stock comprises 10 point cast coated card stock.

6. The greeting card of claim 1 wherein the opening is about one inch smaller in both its horizontal and vertical measurements than the dimensions of the confetti packet.

7. The greeting card of claim 1 wherein the packet comprises two sheets of 30# bleached kraft paper laminated at the periphery of the packet.

8. The greeting card of claim 1 wherein the rupturing adhesive and protective covering comprise double-sided adhesive tape having a removable covering over the exposed surface.

9. The greeting card of claim 8 wherein the horizontal and vertical dimensions of said tape are each about ½" less than the dimensions of the opening.

* * * * *